US012742410B2

(12) United States Patent
Koga et al.

(10) Patent No.: US 12,742,410 B2
(45) Date of Patent: Sep. 22, 2026

(54) MARINE PROPULSION DEVICE

(71) Applicant: YAMAHA HATSUDOKI KABUSHIKI KAISHA, Iwata (JP)

(72) Inventors: Hiroki Koga, Shizuoka (JP); Noriyuki Oba, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 387 days.

(21) Appl. No.: 18/525,952

(22) Filed: Dec. 1, 2023

(65) Prior Publication Data

US 2024/0229702 A1 Jul. 11, 2024

(30) Foreign Application Priority Data

Jan. 11, 2023 (JP) ..... 2023-002397

(51) Int. Cl.
*F01P 3/20* (2006.01)
*B63H 21/17* (2006.01)
*F01P 5/10* (2006.01)

(52) U.S. Cl.
CPC ..... *F01P 3/202* (2013.01); *B63H 21/17* (2013.01); *F01P 5/10* (2013.01)

(58) Field of Classification Search
CPC ..... F01P 3/202; F01P 5/10; B63H 21/17
See application file for complete search history.

(56) References Cited

U.S. PATENT DOCUMENTS

2018/0306306 A1* 10/2018 Hamada ..... F16H 57/0435
2022/0219798 A1 7/2022 Achard et al.
2022/0297812 A1 9/2022 Norton

FOREIGN PATENT DOCUMENTS

EP 3974309 A1 3/2022
JP 2018-177166 A 11/2018

OTHER PUBLICATIONS

Official Communication issued in corresponding European Patent Application No. 24151139.3 mailed on Sep. 6, 2024, 8 pages.

* cited by examiner

*Primary Examiner* — Stephen P Avila
(74) *Attorney, Agent, or Firm* — Keating & Bennett, LLP

(57) ABSTRACT

A marine propulsion device includes an electric motor, a propeller shaft, a lower case, a coolant circulation passage, and a pump. The propeller shaft is driven by the electric motor. The lower case houses the propeller shaft. Coolant to cool the electric motor flows through the coolant circulation passage. The coolant circulation passage includes a cooling passage, a first connection passage, a heat exchange passage, and a second connection passage. The cooling passage extends through the electric motor. The first connection passage is connected to the cooling passage and extends from the cooling passage toward the lower case. The heat exchange passage is connected to the first connection passage and extends through the lower case. The second connection passage is connected to the heat exchange passage and extends from the heat exchange passage to the cooling passage. The pump circulates the coolant through the coolant circulation passage.

6 Claims, 6 Drawing Sheets

MARINE PROPULSION DEVICE

CROSS REFERENCE TO RELATED APPLICATIONS

This application claims the benefit of priority to Japanese Patent Application No. 2023-002397 filed on Jan. 11, 2023. The entire contents of this application are hereby incorporated herein by reference.

BACKGROUND OF THE INVENTION

1. Field of the Invention

The present invention relates to a marine propulsion device.

2. Description of the Related Art

Some marine propulsion devices include an engine and a cooling water passage to cool the engine. For example, the marine propulsion device disclosed in JP-A-2018-177166 has a cooling system including a water pump and a cooling water passage. The water pump is connected to the drive shaft and driven by the driving force of the engine. The water pump takes in water from the outside of the outboard motor through a water intake port provided on the outer surface of the outboard motor, and sends the water to the engine through the cooling water passage. The water that has passed through the engine is discharged to the outside of the outboard motor through the drainage channel.

In recent years, an electric motor may be used instead of an engine as a power source for a marine propulsion device. A marine propulsion device using an electric motor is required to cool the electric motor immediately after the electric motor is started in order to protect the electric parts of the electric motor.

However, in the cooling system described above, when the engine is stopped, the water pump is not driven and cooling water is not supplied to the engine. In addition, since the water outside the marine propulsion device is taken in and pumped up to the engine, it takes time for the engine to be cooled by the cooling water after the engine is started. Therefore, when the cooling system described above is applied to a marine propulsion device using an electric motor, it is difficult to properly cool the electric motor.

SUMMARY OF THE INVENTION

Preferred embodiments of the present invention appropriately cool electric motors in marine propulsion devices.

A marine propulsion device according to a preferred embodiment of the present invention includes an electric motor, a propeller shaft, a lower case, a coolant circulation passage, and a pump. The propeller shaft is driven by the electric motor. The lower case accommodates the propeller shaft. Coolant to cool the electric motor flows through the coolant circulation passage. The coolant circulation passage includes a cooling passage, a first connection passage, a heat exchange passage, and a second connection passage. The cooling passage extends through the electric motor. The first connection passage is connected to the cooling passage and extends from the cooling passage toward the lower case. The heat exchange passage is connected to the first connection passage and extends through the lower case. The second connection passage is connected to the heat exchange passage and extends from the heat exchange passage to the cooling passage. The pump circulates the coolant through the coolant circulation passage.

The marine propulsion device according to another preferred embodiment of the present invention includes an electric motor, a housing, a coolant circulation passage, and a pump. The housing accommodates the electric motor. Coolant to cool the electric motor flows through the coolant circulation passage. The coolant circulation passage includes a cooling passage and a heat exchange passage. The cooling passage extends through the electric motor. The heat exchange passage is connected to the cooling passage and extends through the housing. The pump circulates the coolant through the coolant circulation passage.

According to a preferred embodiment of the present invention, the electric motor is cooled by the coolant circulating through the coolant circulation passage. Therefore, the electric motor can be cooled immediately after the electric motor is started. The electric motor is thus appropriately cooled. Also, the coolant is cooled in the heat exchange passage of the coolant circulation passage. Therefore, the coolant is efficiently cooled by passing through the heat exchange passage.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
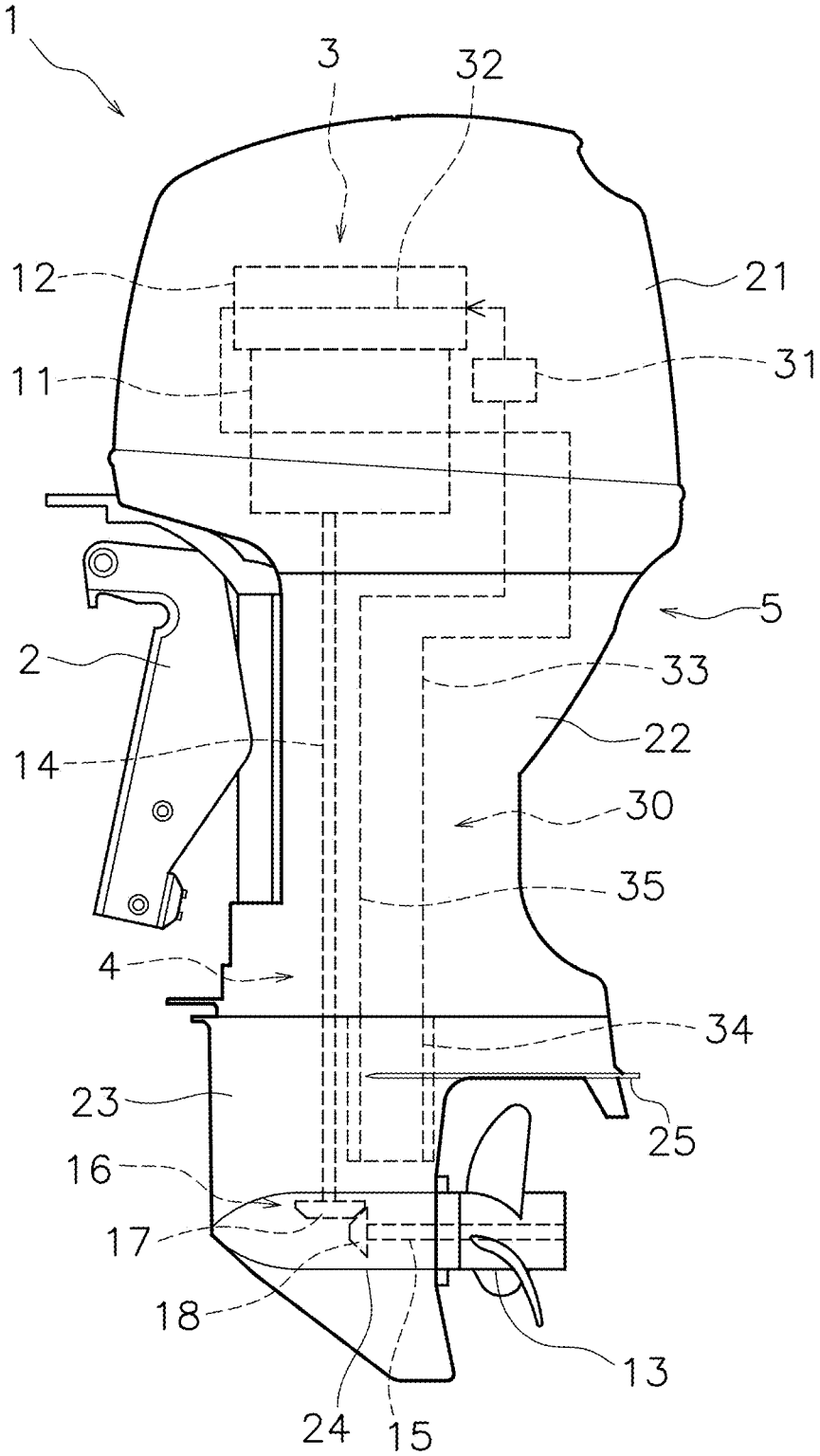
FIG. 1 is a side view of a marine propulsion device according to a preferred embodiment of the present invention.

Preferred embodiments of the present invention will be described below with reference to the drawings. FIG. 1 is a side view of a marine propulsion device 1 according to a preferred embodiment. In this preferred embodiment, the marine propulsion device 1 is an outboard motor. The marine propulsion device 1 includes a bracket 2, a power unit 3, a transmission mechanism 4, and a housing 5. The marine propulsion device 1 is attached to a marine vessel via the bracket 2.

The power unit 3 includes an electric motor 11 and a motor control unit (hereinafter referred to as MCU) 12. The electric motor 11 is driven by electric power from a battery (not shown) and generates thrust to propel the marine vessel. The MCU 12 controls the electric motor 11. The MCU 12 includes electrical components such as a processor and an inverter.

The transmission mechanism 4 transmits the driving force of the electric motor 11 to the propeller 13. The transmission mechanism 4 includes a drive shaft 14, a propeller shaft 15, and a gear mechanism 16. The drive shaft 14 is connected to the electric motor 11. The drive shaft 14 extends in the vertical direction of the marine propulsion device 1. The drive shaft 14 extends downward from the electric motor 11. The propeller shaft 15 extends in the front-back direction of the marine propulsion device 1. The propeller shaft 15 is connected to the drive shaft 14 via the gear mechanism 16. A propeller 13 is attached to the propeller shaft 15.

The gear mechanism 16 includes a first gear 17 and a second gear 18. The first gear 17 and the second gear 18 are in mesh with each other. The first gear 17 is connected to the drive shaft 14. The second gear 18 is connected to the propeller shaft 15. The electric motor 11 rotationally drives the drive shaft 14. Rotation of the drive shaft 14 is transmitted to the propeller shaft 15 via the gear mechanism 16. Thus, the propeller shaft 15 and the propeller 13 are rotationally driven.

The housing 5 includes a cowl 21, an upper case 22, and a lower case 23. The upper case 22 is arranged below the cowl 21. The lower case 23 is arranged below the upper case 22. The lower case 23 is made of metal such as aluminum or stainless steel.

The lower case 23 includes a torpedo portion 24. The torpedo portion 24 has an outwardly bulging shape. The propeller shaft 15 and the gear mechanism 16 are arranged within the torpedo portion 24. A cavitation plate 25 is connected to the lower case 23. The cavitation plate 25 protrudes rearward from the lower case 23.

The electric motor 11 and the MCU 12 are arranged above the lower case 23. The electric motor 11 and the MCU 12 are arranged inside the cowl 21. The drive shaft 14 is arranged inside the upper case 22 and the lower case 23. The propeller shaft 15 and the gear mechanism 16 are arranged inside the lower case 23.

As shown in FIG. 1, the marine propulsion device 1 includes a coolant circulation passage 30 and a pump 31. The coolant circulation passage 30 is filled with the coolant, and the coolant circulation passage 30 defines a closed circuit to circulate the coolant. The coolant circulation passage 30 may include a tank that stores the coolant. The pump 31 circulates the coolant through the coolant circulation passage 30. The pump 31 is, for example, an electric pump and is driven by power from a battery (not shown). The coolant circulation passage 30 includes a cooling passage 32, a first connection passage 33, a heat exchange passage 34, and a second connection passage 35.

The cooling passage 32 passes through the electric motor 11 and the MCU 12. The cooling passage 32 is in contact with the electric motor 11 and the MCU 12. The electric motor 11 and the MCU 12 are cooled by the coolant flowing through the cooling passage 32. The first connection passage 33 is connected to the cooling passage 32. The first connection passage 33 extends from the cooling passage 32 toward the lower case 23. The first connection passage 33 extends from the cowl 21 toward the lower case 23 through the inside of the upper case 22.

The heat exchange passage 34 is connected to the first connection passage 33. The heat exchange passage 34 passes through the lower case 23. The heat exchange passage 34 is arranged inside the lower case 23. A portion of the heat exchange passage 34 is arranged below the cavitation plate 25. The entire heat exchange passage 34 may be arranged below the cavitation plate 25. The heat exchange passage 34 is arranged behind the drive shaft 14. The heat exchange passage 34 is arranged above the torpedo portion 24.

The heat exchange passage 34 causes heat exchange between the lower case 23 and the coolant. The coolant is thus cooled in the heat exchange passages 34. The second connection passage 35 is connected to the heat exchange passage 34. The second connection passage 35 extends from the heat exchange passage 34 to the cooling passage 32. The second connection passage 35 extends from the lower case 23 toward the cowl 21 through the upper case 22.

Figure 2:
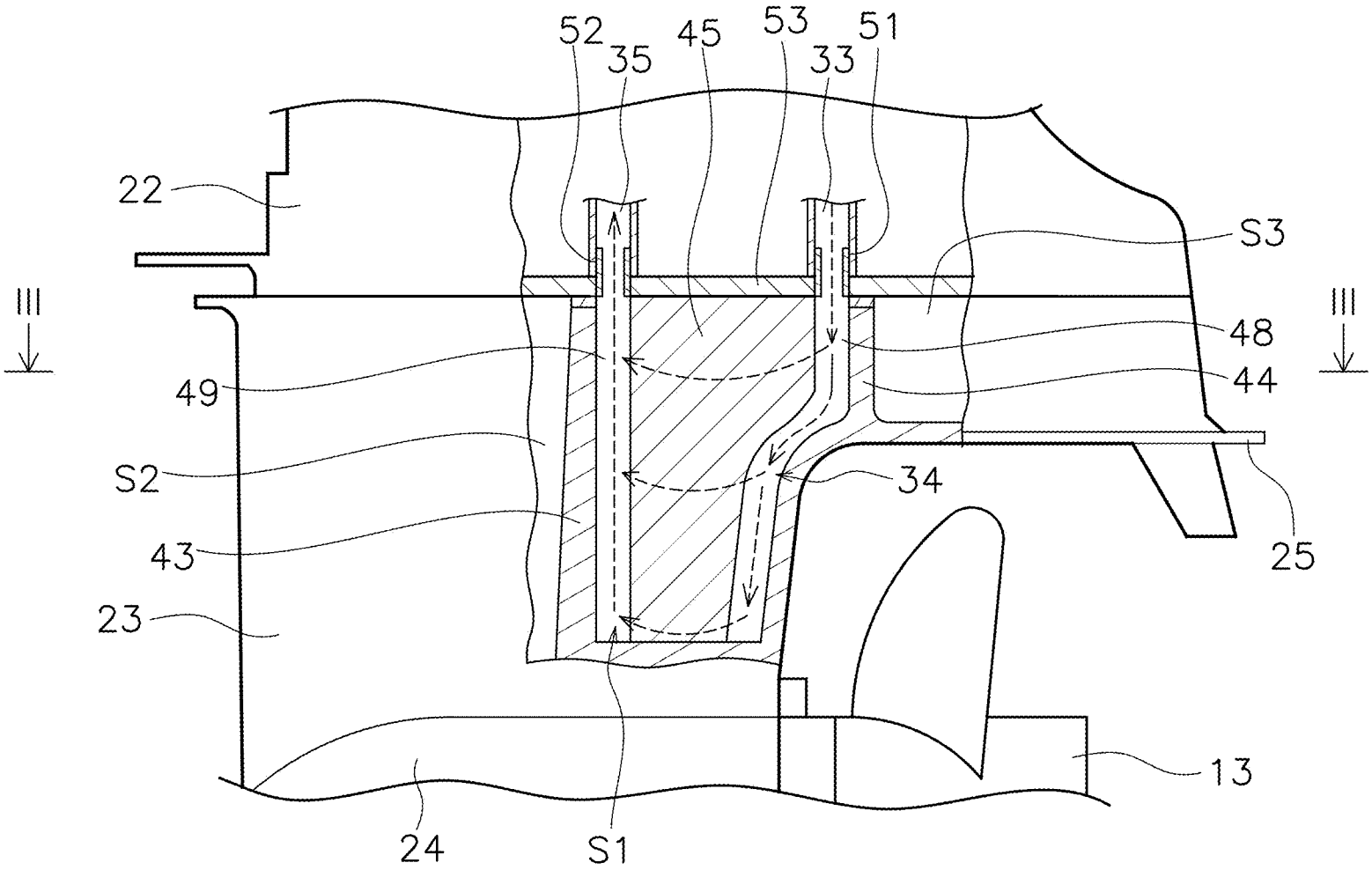
FIG. 2 is an enlarged side view of the marine propulsion device.
Figure 3:
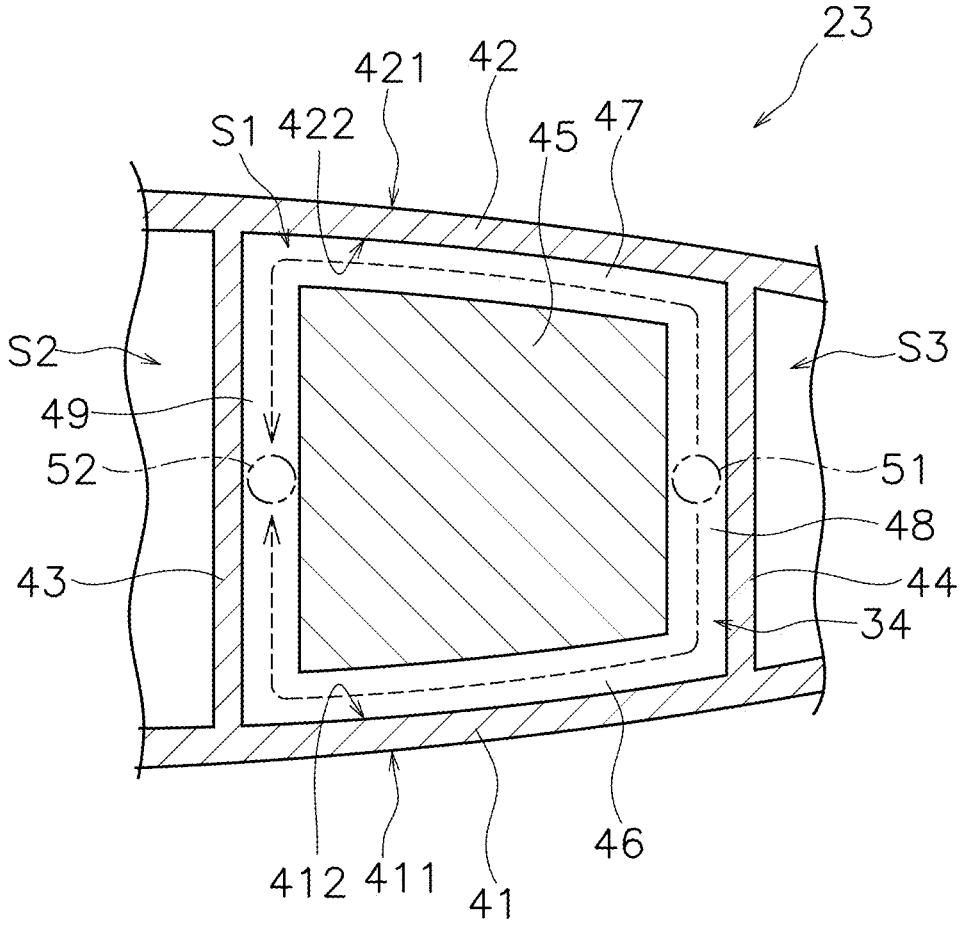
FIG. 3 is a cross-sectional view of a lower case taken along line III-III in FIG. 2.

FIG. 2 is an enlarged side view showing the inside of lower case 23 and the upper case 22. FIG. 3 is a sectional view taken along line III-III in FIG. 2. As shown in FIGS. 2 and 3, the lower case 23 includes internal spaces S1 to S3 and side walls 41 and 42. The side walls 41 and 42 enclose the internal spaces S1 to S3. The side walls 41 and 42 include outer surfaces 411 and 421 and inner surfaces 412 and 422. The outer surfaces 411 and 421 face the outside of the marine propulsion device 1. When the marine propulsion device 1 is in use, the lower case 23 is located underwater. Therefore, the outer surfaces 411 and 421 are in contact with water when the marine propulsion device 1 is in use.

The internal spaces S1 to S3 include a first internal space S1, a second internal space S2, and a third internal space S3. The inner surfaces 412 and 422 face the first internal space S1. The heat exchange passages 34 are arranged inside the side walls 41 and 42. The heat exchange passages 34 are arranged facing the inner surfaces 412 and 422 of the side walls 41 and 42.

Specifically, as shown in FIG. 3, the lower case 23 includes a left side wall 41, a right side wall 42, a front partition 43, a rear partition 44, and an internal partition 45. The left side wall 41, the right side wall 42, the front partition 43, and the rear partition 44 are integral with each other. The internal partition 45 is separate from the left side wall 41, the right side wall 42, the front partition 43, and the rear partition 44. Alternatively, at least a portion of the left side wall 41, the right side wall 42, the front partition 43, and the rear partition 44 may be separate bodies. The internal partition 45 may be integral with the left side wall 41, the right side wall 42, the front partition 43, and the rear partition 44.

The left side wall 41 and the right side wall 42 surround the internal spaces S1 to S3. The front partition 43 is arranged across the left side wall 41 and the right side wall 42. The front partition 43 extends in the left-right direction and is connected to the left side wall 41 and the right side wall 42. The front partition 43 separates the first internal space S1 and the second internal space S2. The second internal space S2 is arranged in front of the first internal space S1. The drive shaft 14 is arranged in the second internal space S2. The rear partition 44 separates the first internal space S1 and the third internal space S3. The third internal space S3 is arranged behind the first internal space S1.

The heat exchange passage 34 is arranged in the first internal space S1. The internal partition 45 is arranged in the first internal space S1. As shown in FIG. 3, the heat exchange passage 34 has a loop shape in a cross-sectional view on a horizontal plane. Specifically, the heat exchange passages 34 include a left passage 46, a right passage 47, an inlet passage 48, and an outlet passage 49. The left passage 46 is provided between the internal partition 45 and the left side wall 41. The left passage 46 is connected to the inlet passage 48 and the outlet passage 49. The right passage 47 is provided between the internal partition 45 and the right side wall 42. The right passage 47 is connected to the inlet passage 48 and the outlet passage 49. The inlet passage 48 is provided between the internal partition 45 and the rear partition 44. The outlet passage 49 is provided between the internal partition 45 and the front partition 43.

As shown in FIG. 2, the heat exchange passage 34 includes an inlet 51 and an outlet 52. The first connection passage 33 is connected to the inlet 51. The second connection passage 35 is connected to the outlet 52. The first connection passage 33 and the second connection passage 35 may be, for example, hoses. Alternatively, the first connection passage 33 and the second connection passage 35 may be pipes. The upper portion of the heat exchange passage 34 is closed by an upper partition wall 53. The upper partition wall 53 is a separate body from the lower case 23. The upper partition wall 53 is made of metal such as aluminum or stainless steel. The inlet 51 and the outlet 52 are provided in the upper partition wall 53. The inlet 51 communicates with the inlet passage 48. The outlet 52 communicates with the outlet passage 49.

As shown in FIG. 1, in the marine propulsion device 1 according to the present preferred embodiment, the coolant is circulated through the coolant circulation passage 30 by the pump 31. The coolant cools the electric motor 11 and the MCU 12 by passing through the cooling passage 32. The coolant is sent to the heat exchange passage 34 through the first connection passage 33.

As shown in FIGS. 2 and 3, the coolant enters the inlet passage 48 through the inlet 51. The coolant flows from the inlet passage 48 into the left passage 46 and the right passage 47, and then into the outlet passage 49. The coolant flowing through the left passage 46 exchanges heat with the water outside the marine propulsion device 1 or the air outside the marine propulsion device 1 via the left side wall 41. The coolant flowing through the right passage 47 exchanges heat with water outside the marine propulsion device 1 or air outside the marine propulsion device 1 via the right side wall 42. The coolant is thus cooled in the heat exchange passages 34.

The coolant flows from the outlet passage 49 through the outlet 52 and into the second connection passage 35. The coolant flows through the second connection passage 35 to the cooling passage 32. As the coolant circulates through the coolant circulation passage 30 as described above, cooling of the electric motor 11 and the MCU 12 in the cooling passage 32 and heat exchange in the heat exchange passage 34 are repeated.

In the marine propulsion device 1 according to the present preferred embodiment described above, the electric motor 11 is cooled by the coolant circulating through the coolant circulation passage 30. Therefore, the electric motor 11 can be cooled immediately after the electric motor 11 is started. Thus, the electric motor 11 is appropriately cooled. Also, the coolant is cooled in the heat exchange passage 34 of the coolant circulation passage 30. Therefore, the coolant is efficiently cooled by passing through the heat exchange passage 34.

Although preferred embodiments of the present invention have been described above, the present invention is not limited to the above-described preferred embodiments, and various modifications are possible without departing from the gist of the invention.

The marine propulsion device 1 is not limited to an outboard motor, and may be another propulsion device such as an inboard/outboard motor. The arrangement of the electric motor 11 is not limited to that of the above preferred embodiments, and may be changed. For example, the electric motor 11 may be arranged inside the upper case 22. Alternatively, the electric motor 11 may be arranged inside the lower case 23. The arrangement of the MCU 12 is not limited to that of the above preferred embodiments, and may be changed. For example, the MCU 12 may be arranged at a position away from the electric motor 11.

The configuration or arrangement of the coolant circulation passage 30 is not limited to that of the above preferred embodiments, and may be modified. The cooling passage 32 may be provided so as to pass through only one of the electric motor 11 and MCU 12. Separate cooling passages may be provided to pass through the electric motor 11 and the MCU 12 respectively.

Figure 4:
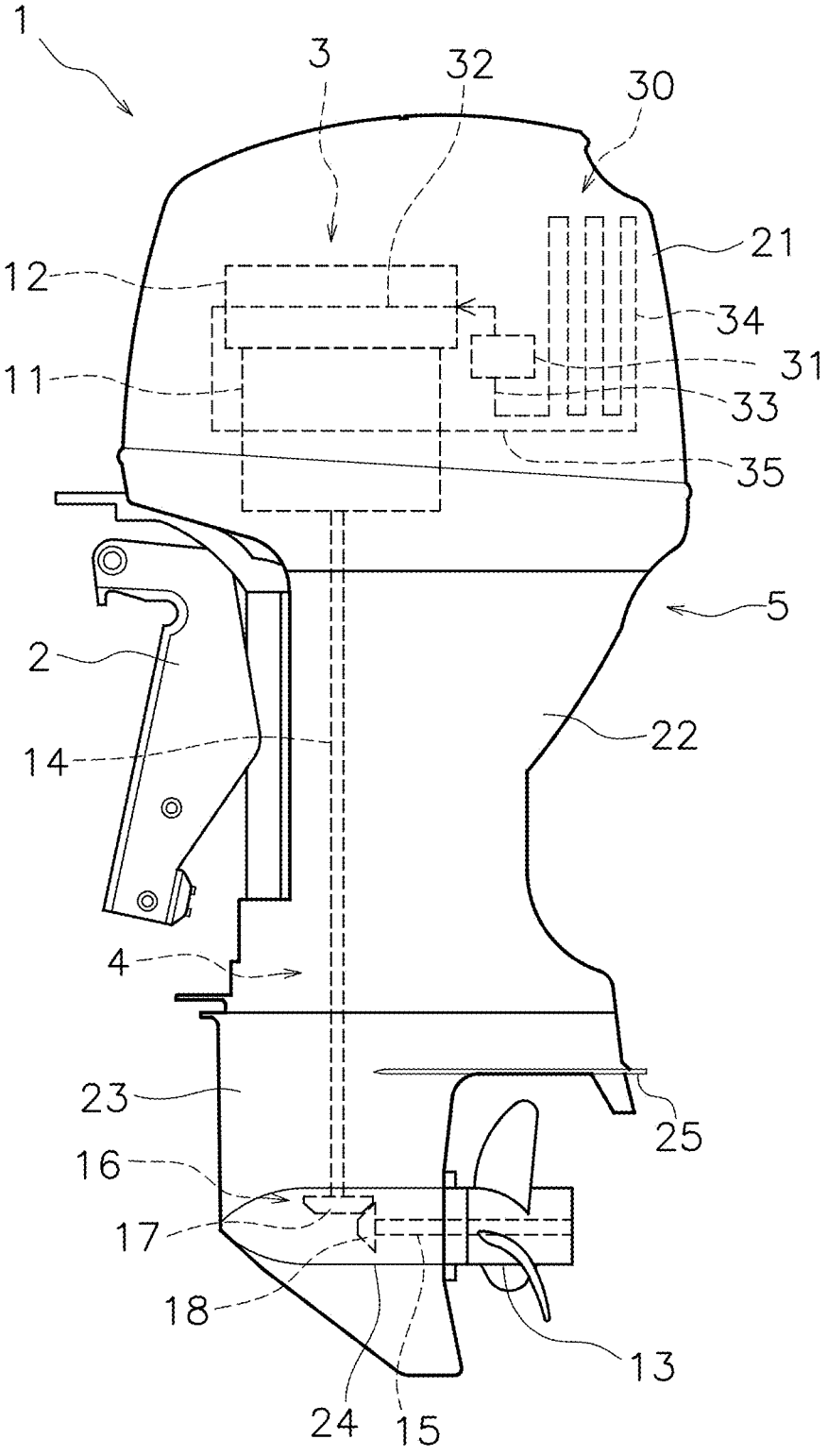
FIG. 4 is a side view of a marine propulsion device according to a first modified example of a preferred embodiment of the present invention.
Figure 5:
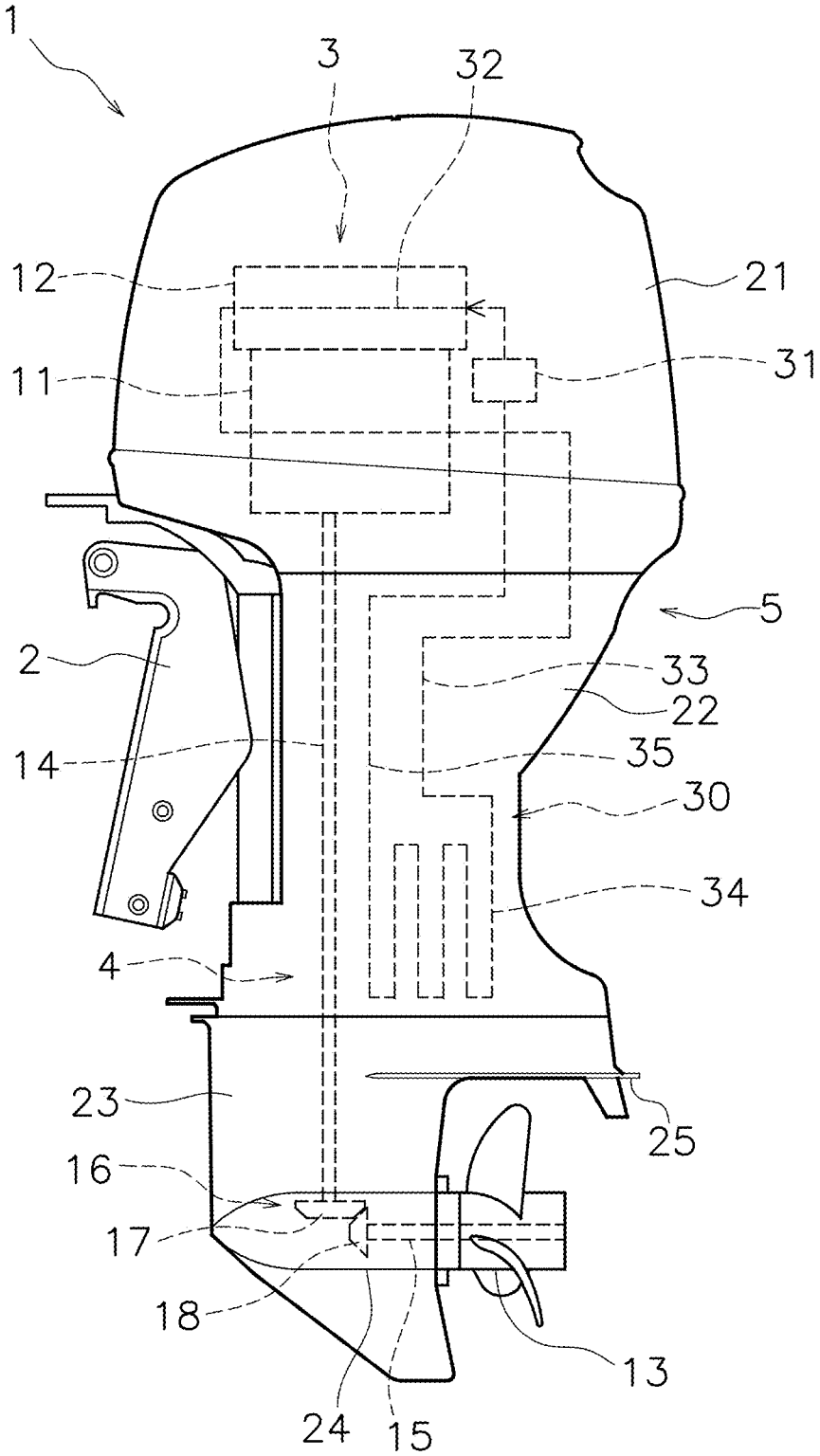
FIG. 5 is a side view of a marine propulsion device according to a second modified example of a preferred embodiment of the present invention.

The arrangement of the heat exchange passages 34 is not limited to that of the above preferred embodiments, and may be changed. For example, FIG. 4 is a side view of a marine propulsion device 1 according to a first modified example. As shown in FIG. 4, the heat exchange passages 34 may be provided in the cowl 21. Alternatively, FIG. 5 is a side view of a marine propulsion device 1 according to a second modified example. As shown in FIG. 5, the heat exchange passages 34 may be provided in the upper case 22. In this case, the marine propulsion device 1 may include a pump to pull up water outside the marine propulsion device 1 to the cowl 21 or the heat exchange passage 34 in the upper case 22. The pump may supply coolant to a component other than the electric motor 11 and MCU 12.

Figure 6:
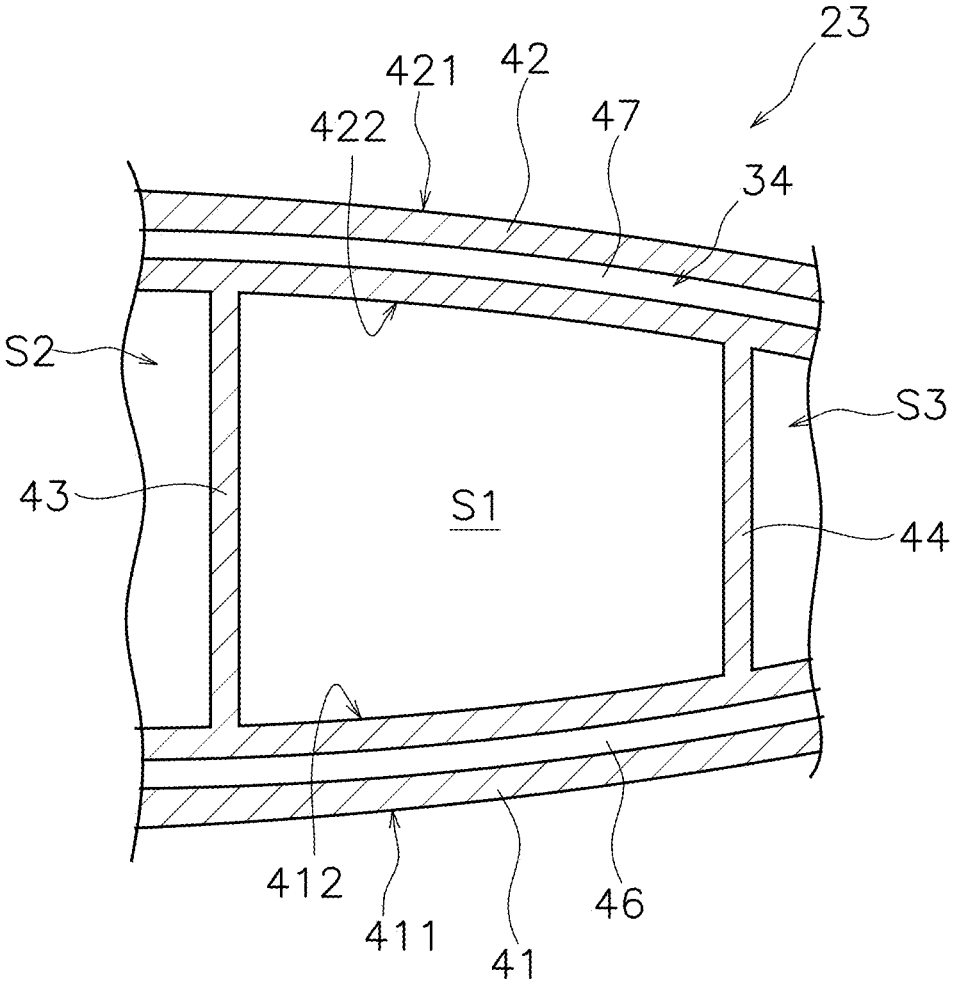
FIG. 6 is a cross-sectional view of a lower case of a marine propulsion device according to a third modified example of a preferred embodiment of the present invention.

The configuration of the heat exchange passage 34 is not limited to that of the above preferred embodiments, and may be modified. For example, FIG. 6 is a cross-sectional view of a lower case 23 of a marine propulsion device according to a third modified example. As shown in FIG. 6, the heat exchange passages 34 may be provided inside side walls 41 and 42 of the lower case 23. That is, the heat exchange passages 34 may be provided between the outer surface 411 and the inner surface 412 of the left side wall 41 and between the outer surface 421 and the inner surface 422 of the right side wall 42. Alternatively, the heat exchange passage 34 may be provided inside the side wall of the upper case 22. Alternatively, the heat exchange passages 34 may be provided inside the side wall of the cowl 21.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

an electric motor;

a cowl housing the electric motor;

a propeller shaft to be driven by the electric motor;

a drive shaft extending downward from the electric motor;

an upper case below the cowl and housing the drive shaft;

a lower case below the upper case and housing the propeller shaft;

a coolant circulation passage through which a coolant to cool the electric motor flows, and including:

a cooling passage extending through the electric motor;

a first connection passage connected to the cooling passage and extending from the cooling passage toward the lower case;

a heat exchange passage connected to the first connection passage and extending through the lower case; and a second connection passage connected to the heat exchange passage and extending from the heat exchange passage to the cooling passage; and a pump to circulate the coolant in the coolant circulation passage.

2. The marine propulsion device according to claim 1, wherein the electric motor is above the lower case.

3. The marine propulsion device according to claim 1, wherein the lower case includes an internal space and a side wall surrounding the internal space; and the heat exchange passage is inside the side wall.

4. The marine propulsion device according to claim 1, wherein the lower case includes an internal space and a side wall surrounding the internal space;

the side wall includes an outer surface facing an outside of the marine propulsion device, and an inner surface facing the inner space; and the heat exchange passage is between the outer surface and the inner surface.

5. The marine propulsion device according to claim 1, wherein the lower case includes a cavitation plate, and at least a portion of the heat exchange passage is below the cavitation plate.

6. The marine propulsion device according to claim 1, further comprising:

a motor controller configured or programmed to control the electric motor; wherein the cooling passage extends through the motor controller.

* * * * *